US007850510B2

(12) United States Patent
Hersgren et al.

(10) Patent No.: US 7,850,510 B2
(45) Date of Patent: Dec. 14, 2010

(54) PORTABLE GRINDER WITH A WHEEL-GUARD SUPPORT AND AUXILIARY HANDLE

(75) Inventors: Lars Jonas Hersgren, Älta (SE); Anders Urban Nelson, Älvsjö (SE)

(73) Assignee: Atlas Copco Tools AB, Nacka (SE)

( * ) Notice: Subject to any disclaimer, the term of this patent is extended or adjusted under 35 U.S.C. 154(b) by 228 days.

(21) Appl. No.: 12/085,286

(22) PCT Filed: Nov. 22, 2006

(86) PCT No.: PCT/SE2006/001324

§ 371 (c)(1),
(2), (4) Date: Jun. 19, 2008

(87) PCT Pub. No.: WO2007/061359

PCT Pub. Date: May 31, 2007

(65) Prior Publication Data

US 2008/0293338 A1 Nov. 27, 2008

(30) Foreign Application Priority Data

Nov. 24, 2005 (SE) ..... 0502565

(51) Int. Cl.
*B24B 23/02* (2006.01)

(52) U.S. Cl. ..... 451/344; 451/354; 451/358; 451/359; 451/451

(58) Field of Classification Search ..... 451/354, 451/356, 357, 358, 359, 451, 452, 457, 344
See application file for complete search history.

(56) References Cited

U.S. PATENT DOCUMENTS

| | | | | | |
|---|---|---|---|---|---|
| 2,080,973 | A | * | 5/1937 | Speth | 192/34 |
| D168,901 | S | * | 2/1953 | Maclay | D8/62 |
| 3,591,989 | A | * | 7/1971 | Granlie | 451/451 |
| 5,768,786 | A | * | 6/1998 | Kane et al. | 30/276 |
| 5,911,281 | A | * | 6/1999 | Treskog et al. | 173/104 |
| D439,819 | S | * | 4/2001 | Bass et al. | D8/70 |
| 6,389,701 | B1 | * | 5/2002 | Friedland | 30/391 |
| 6,561,063 | B1 | * | 5/2003 | Mulford et al. | 82/128 |
| D559,057 | S | * | 1/2008 | Pan | D8/61 |
| 2005/0188552 | A1 | | 9/2005 | Gist et al. | |

FOREIGN PATENT DOCUMENTS

| | | |
|---|---|---|
| DE | 27 39 982 A1 | 3/1979 |
| RU | 2 032 520 C1 | 4/1995 |
| SU | 1158333 A | 5/1985 |

* cited by examiner

*Primary Examiner*—Timothy V Eley
(74) *Attorney, Agent, or Firm*—Holtz, Holtz, Goodman & Chick, PC

(57) ABSTRACT

A straight type power grinder includes an elongate housing having a handle with a power controller at its rear end, and a neck portion at its forward end supporting an output shaft connected to a rotation motor. The neck portion is formed with an integrated mounting flange for a grinding wheel guard. The neck portion and the mounting flange form an auxiliary handle for a comfortable manual support of the grinder during operation.

4 Claims, 1 Drawing Sheet

PORTABLE GRINDER WITH A WHEEL-GUARD SUPPORT AND AUXILIARY HANDLE

This application is a U.S. National Phase Application under 35 USC 371 of International Application PCT/SE2006/001324 filed Nov. 22, 2006.

FIELD OF THE INVENTION

The invention relates to a portable power grinder which comprises a housing, a rotation motor, an output shaft carrying a grinding wheel, and a grinding wheel guard mounted on the housing. In particular, the invention concerns a straight type of power grinder including an elongate housing with the output shaft protruding from its forward end.

BACKGROUND OF THE INVENTION

Portable grinders of the straight type include a housing provided at its rear end with a handle and a power control means, such as a throttle valve in the case of a pneumatic tool. However, for getting a good control of the tool and to be able to apply a feeding force on the tool the operator also uses the forward end of the housing as an auxiliary handle. Normally, the grinder wheel guard is mounted on a coaxial neck portion of the housing and is secured thereto by means of a clamping device. This makes a rather non-ergonomic auxiliary handle, because the clamping device presents sharp edges and is not at all adapted to be a part of a handle. Thus, using the forward end of the housing as a handle has been far from comfortable for the operator.

SUMMARY OF THE INVENTION

The main object of the invention is to create an improved straight type power grinder with a housing having a wheel guard mounting means which provides a more comfortable auxiliary handle for a better manual control of the grinder during operation.

A further object of the invention is to provide a power grinder housing with a grinding wheel guard mounting means forming a part of an auxiliary handle and offering alternative wheel guard mounting positions.

Further characteristic features and advantages of the invention will appear from the following specification and claims.

A preferred embodiment of the invention is described in detail below with reference to the accompanying drawings.

DETAILED DESCRIPTION

Figure 1:
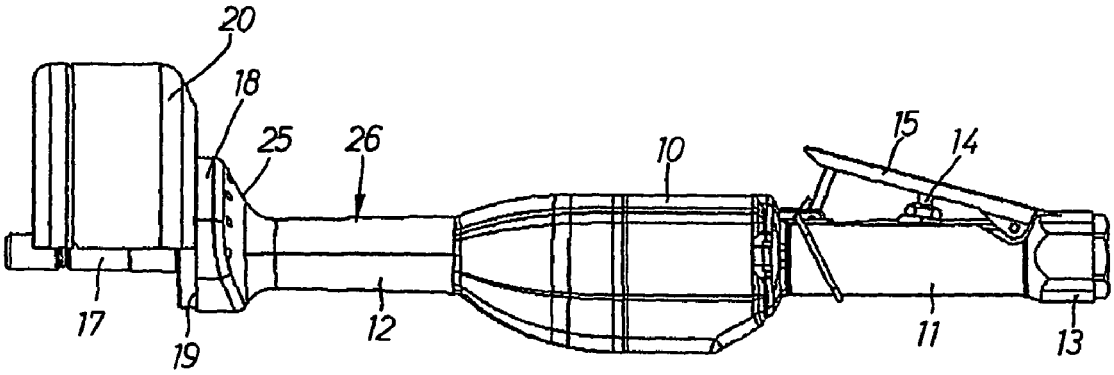
FIG. 1 shows a side view of a power grinder according to the invention.

The power grinder illustrated in the drawing figures is a pneumatic grinder which comprises an elongate housing 10 provided with a handle 11 at its rear end, and a tubular neck portion 12 at its forward end. The handle 11 is provided with a pressure air conduit connection 13, and a throttle valve 14 operated by a lever 15. The grinder further comprises a non-illustrated rotation motor drivingly connected to an output shaft 17 which is co-axially supported and journalled in the neck portion 12. The output shaft 17 protrudes at the forward end of the housing 10 and is and arranged to carry a grinding wheel.

Figure 2:
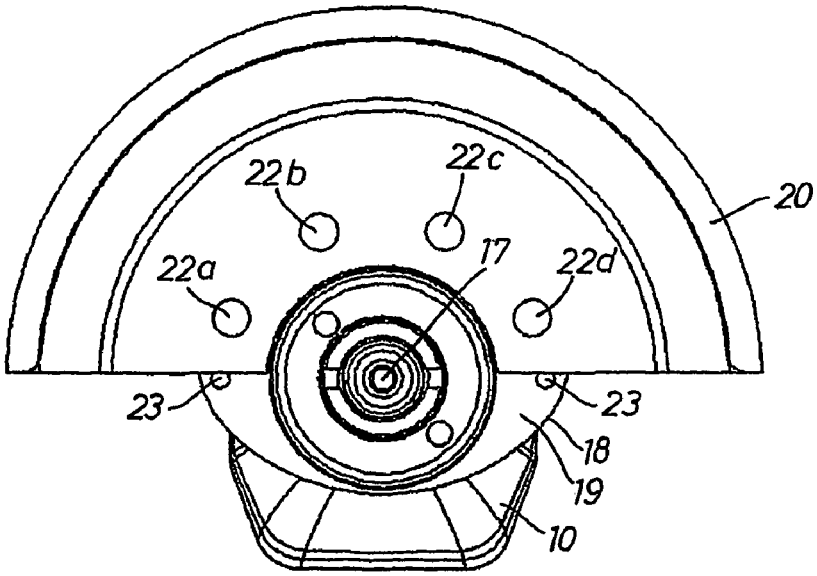
FIG. 2 shows a front end view of the grinder in FIG. 1.

At a forward end of the housing 10 and formed as an integrated part of the neck portion 12 there is provided a mounting flange 18 with a flat front mounting surface 19 for a grinding wheel guard 20. The mounting flange 18 extends over the major part of the neck portion 12 circumference but leaves a sector opposite the wheel guard 20 to avoid interference with the work piece during operation. The grinding wheel guard 20 is provided with four retaining screws 22*a-d* for engagement with corresponding bores 23 in the mounting flange 18. See FIG. 2. The mounting flange 18 bores 23 are more in numbers than the screws 22*a-d* so as to enable mounting of the wheel guard 20 in at least two alternative angular positions relative to the housing 10.

The mounting flange 18 forms an auxiliary handle 26 together with the neck portion 12, and the flange 18 is formed with a conical surface 25 so as to form a comfortable grip and an axial hand supporting means for the operator. In this type of power grinders it is essential to enable manual support of the tool during operation in two different positions, namely at the rear of the housing via a handle, and at the forward end of the housing via a front end neck portion of the housing. This is accomplished according to the invention by the neck portion 12 in combination with the radial wheel guard mounting flange 18 which is integrated with the neck portion 12 and forms via its conical surface 25 a comfort enhancing part of the auxiliary handle 26.

The invention claimed is:

1. A straight type portable power grinder, comprising:
- an elongate housing having a front end and a rear end;
- a rotation motor; and
- an output shaft arranged to carry a grinding wheel;
- wherein the housing is provided with a handle at the rear end thereof and a tubular neck portion at the front end thereof, the neck portion coaxially surrounds the output shaft and forms an auxiliary handle, and a grinding wheel guard is supported on the neck portion; and
- wherein the neck portion comprises a mounting flange for mounting the grinding wheel guard, and the mounting flange comprises:
  - a substantially flat front mounting surface which extends perpendicularly to the output shaft and is adapted for mounting the grinding wheel guard;
  - a number of bores formed in the mounting surface which receive retaining screws for securing the grinding wheel guard to the mounting surface; and
  - a conical surface which forms an axial hand supporting part of the auxiliary handle.

2. The power grinder according to claim 1, wherein the mounting flange extends over at least half of a circumference of the neck portion, and there is a sector opposite the grinding wheel guard where the mounting flange is not provided, to avoid interference with a work piece during operation.

3. The power grinder according to claim 1, wherein the number of bores in the mounting surface is greater than a number of the retaining screws, to enable mounting of the grinding wheel guard in at least two angular positions relative to the housing.

4. The power grinder according to claim 2, wherein the number of bores in the mounting surface is greater than a number of the retaining screws, to enable mounting of the grinding wheel guard in at least two angular positions relative to the housing.

* * * * *